US010218108B2

(12) United States Patent
Scholeno et al.

(10) Patent No.: US 10,218,108 B2
(45) Date of Patent: Feb. 26, 2019

(54) ELECTRICAL CONNECTOR ASSEMBLY

(71) Applicant: FCI USA LLC, Etters, PA (US)

(72) Inventors: Michael Scholeno, York, PA (US); Michael T. Craton, Harrisburg, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/665,218

(22) Filed: Jul. 31, 2017

(65) Prior Publication Data

US 2018/0076555 A1 Mar. 15, 2018

Related U.S. Application Data

(60) Provisional application No. 62/369,628, filed on Aug. 1, 2016.

(51) Int. Cl.

| | |
|---|---|
| ***H01R 13/648*** | (2006.01) |
| ***H01R 13/502*** | (2006.01) |
| ***H01R 13/6477*** | (2011.01) |
| ***H01R 13/6594*** | (2011.01) |
| ***H01R 43/20*** | (2006.01) |
| ***H01R 13/6585*** | (2011.01) |
| *H01R 12/71* | (2011.01) |

(52) U.S. Cl.

CPC ..... *H01R 13/502* (2013.01); *H01R 13/6477* (2013.01); *H01R 13/6585* (2013.01); *H01R 13/6594* (2013.01); *H01R 43/20* (2013.01); *H01R 12/716* (2013.01)

(58) Field of Classification Search

CPC .. H01R 13/648; H01R 13/502; H01R 13/514; H01R 12/724; H01R 12/727

See application file for complete search history.

(56) References Cited

U.S. PATENT DOCUMENTS

| | | | | |
|---|---|---|---|---|
| 7,175,446 | B2 * | 2/2007 | Bright | H01R 23/688 439/79 |
| 7,503,804 | B2 * | 3/2009 | Minich | H01R 12/585 439/607.05 |
| 8,062,065 | B2 * | 11/2011 | Whiteman, Jr. | H01R 13/514 439/607.07 |
| 8,280,413 | B2 | 10/2012 | Choi et al. | |
| 8,764,483 | B2 * | 7/2014 | Ellison | H01R 12/724 439/607.07 |
| 9,214,768 | B2 * | 12/2015 | Pao | H01R 13/6587 |
| 9,277,649 | B2 * | 3/2016 | Ellison | H01R 12/523 |
| 2001/0012729 | A1 * | 8/2001 | Van Woensel | H01R 13/6587 439/607.07 |
| 2003/0220019 | A1 * | 11/2003 | Billman | H01R 13/514 439/607.07 |

* cited by examiner

*Primary Examiner* — Xuong Chung Trans

(74) *Attorney, Agent, or Firm* — Wolf, Greenfield & Sacks, P.C.

(57) ABSTRACT

An electrical connector is disclosed having a multi-piece connector housing. The housing pieces may be configured to fit together with separation between interior surfaces of the separately manufactured housing pieces. This separation selectively introduces pockets of air adjacent portions of the mating contacts within the connector. The packets of air may be preferentially positioned to provide a more uniform impedance along the length of a mating contact. The separation may be introduced near the mating interface of a receptacle connector, for example, to counter the effects of changes in contact geometry at the mating interface.

20 Claims, 13 Drawing Sheets

ELECTRICAL CONNECTOR ASSEMBLY

RELATED APPLICATIONS

This application claims priority to and the benefit of U.S. Provisional Patent Application No. 62/369,628, entitled, "ELECTRICAL CONNECTOR ASSEMBLY" filed Aug. 1, 2016. The entire contents of the foregoing are hereby incorporated herein by reference.

BACKGROUND

Electrical connectors are configured to transfer electrical signals between complementary electrical components. For instance, an electrical connector can be mounted to a first complementary electrical component, and mated to a second complementary electrical component so as to place the first and second complementary components in electrical communication with each other. The electrical connector can include a dielectric or electrically insulative connector housing and electrical conductors supported by the connector housing. For instance, the electrical conductors can include signal conductors and ground conductors that are disposed between respective ones, pairs, or other quantities, of the signal conductors. The signal conductors can carry data signals, optical signals, or the like between the first and second complementary electrical components. The electrical conductors of some types of electrical connector can further include electrical power conductors that are configured to transmit electrical power between the first and second complementary electrical components.

Certain electrical connectors are configured to mate with at least one substrate, which can be configured as a printed circuit board, that includes the electrical conductors. Such printed circuit boards are commonly referred to as paddle cards. For instance, the electrical conductors can be configured as electrical traces that are disposed on an exterior surface of the substrate, disposed in an interior layer of the substrate, or can have a portion that is disposed on the exterior surface and a portion that is disposed in an interior layer of the substrate. Certain electrical connectors can be configured to mate with one paddle card, while others can be configured to mate with first and second paddle cards, thought it should be appreciated that the present disclosure is not limited to the number of paddle cards. The electrical connector can be configured to be mounted to a substrate, such as a printed circuit board. Thus, the first complementary electrical component can be configured as a printed circuit board, which can be configured to transfer electrical data. The second complementary electrical component can be configured as at least one paddle card that, in turn, is in electrical communication with an auxiliary component such as a transceiver.

Examples of such electrical connectors include serial attached small computer system interface ("SAS") connectors and its variants, such as mini-SAS and mini-SAS HD connectors. Accordingly, reference herein to SAS connectors is intended to refer to all such SAS connectors and their variants, including but not limited to mini-SAS and mini-SAS HD, unless otherwise indicated, and all other electrical connectors that are configured to receive at least one paddle card.

SUMMARY

In accordance with one example of the present disclosure, an electrical connector can include an electrically insulative connector housing. The connector housing can include i) a first housing member, ii) a second housing member separate from the first housing member, opposite the first housing member, and attached to the first housing member, and iii) an inner housing member interposed between the first housing member and the second housing member, wherein the first housing member defines a receptacle configured to receive a paddle card. The electrical connector can further include a plurality of leadframe assemblies supported by the connector housing, each of the leadframe assemblies including an electrically insulated leadframe housing and a plurality of electrical contacts supported by the leadframe housing, each of the electrical contacts defining a mating portion at the receptacle so as to be configured to contact the received paddle card, and a mounting portion opposite the mating portion. The electrical connector can further include a plurality of ground plates disposed between respective ones of the leadframe assemblies, the grounds each defining a ground mating portion at the receptacle so as to be configured to contact the received paddle card, and a ground mounting portion opposite the ground mating portion.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
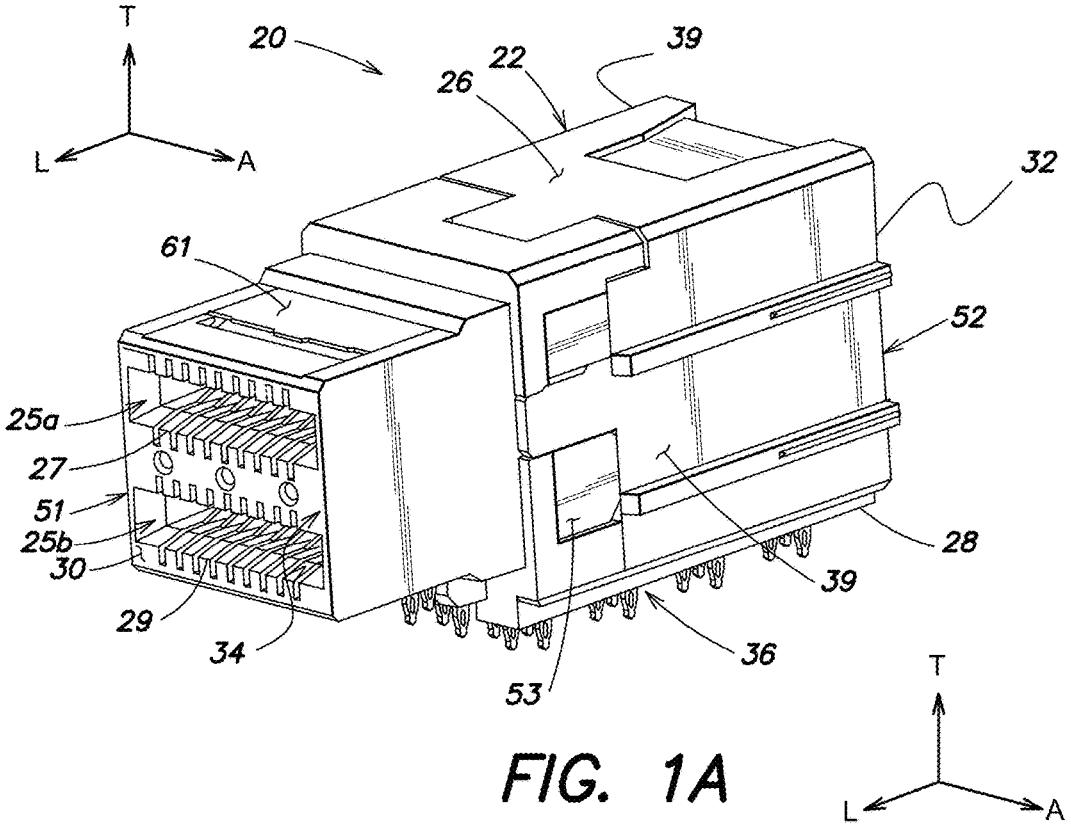
FIG. 1A is a perspective view of an electrical connector constructed in accordance with one embodiment.
Figure 1B:
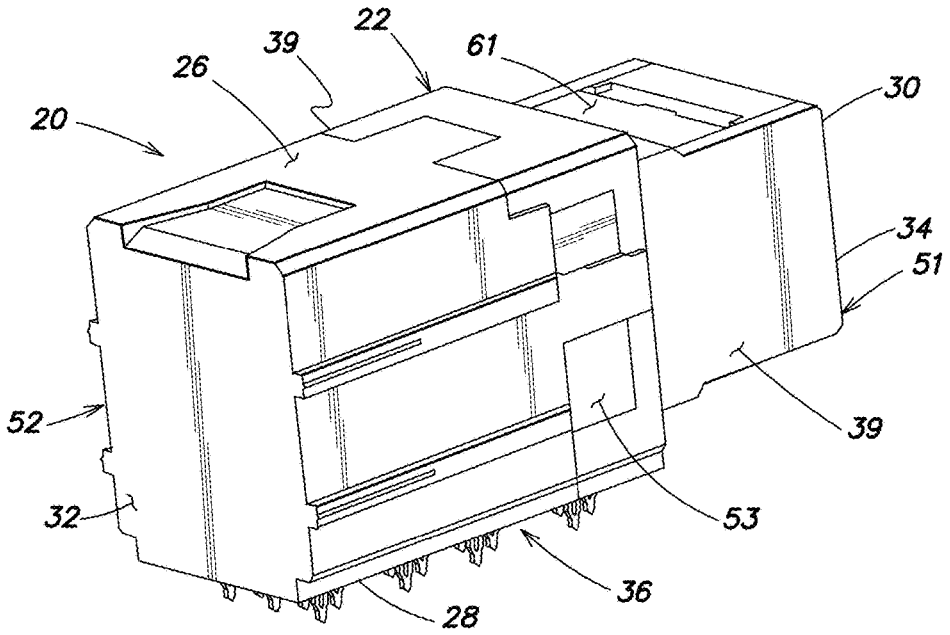
FIG. 1B is a perspective view of the electrical connector illustrated in FIG. 1A.

Referring to FIGS. 1A-2 and 8A-8B, an electrical connector 20, such as a SAS connector, includes an electrically insulative connector housing 22 and a plurality of electrical contacts 24 supported by the connector housing 22. The connector housing 22 includes a first or front housing member 51 and a second or rear housing member 52 that is separate from the first housing member 51, and opposite the first housing member 51 along a longitudinal direction L. In particular, the front housing member 51 can be said to be spaced from the second housing member 52 along a forward direction. Similarly, the second housing member 52 can be said to be spaced from the first housing member 51 along a rearward direction. The connector housing 22 further includes an inner housing member 53 interposed between the first and second housing members 51 and 52, respectively, with respect to the longitudinal direction L, when the first and second housing members 51 and 52 are attached to each other. For instance, at least a portion of the inner housing member 53 can nest in the first housing member 51 when the first and second housing members 51 and 52 are attached to each other.

The electrical contacts 24 can be configured as signal contacts. The electrical connector 20 further includes electrical grounds 41 disposed adjacent certain ones of the electrical contacts 24 along a row direction 31. The electrical contacts 24 and grounds 41 are described in more detail below. The electrical connector 20 is configured to mate with at least one substrate that can be configured as a paddle card. For instance, the at least one first substrate can include a pair of substrates, each configured as a paddle card. The paddle cards can be configured as printed circuit boards that include signal contact pads and ground contact pads that are configured to mate with respective ones of the electrical contacts 24 and grounds 41.

The electrical connector 20 is further configured to be mounted to a second substrate. The second substrate can be configured as a printed circuit board. Thus, the electrical contacts 24 and grounds 41 are placed in electrical communication with complementary electrical traces of the second substrate, thereby placing the electrical connector 20 in electrical communication with the second substrate. The second substrate can be configured as a printed circuit board. When the electrical connector 20 is mated to the at least one paddle card and the second substrate, the electrical contacts 24 and grounds 41 are placed in electrical communication with complementary electrical traces of each of the at least one paddle card and the second substrate. Accordingly, when the electrical connector 20 is mated with the at least one paddle card and mounted to the second substrate, each at least one paddle card is placed in electrical communication with the second substrate through the electrical connector 20.

The connector housing 22 defines a top end 26 and a bottom end 28 that is opposite the top end 26 along a transverse direction T. The connector housing 22 further defines a front end 30 and a rear end 32 that is opposite the front end 30 along the longitudinal direction L. For instance, the front end 30 can be defined by the first housing member 51, and the second end 32 can be defined by the second housing member 52. The longitudinal direction L is oriented perpendicular to the transverse direction T. The forward direction and rearward directions can be oriented along the longitudinal direction L. Thus, the front end 30 is spaced from the rear end 32 in a forward direction of the electrical connector 20. The rear end 32 is spaced from the front end in a rearward direction of the electrical connector 20. The connector housing 22 further includes opposed sides 39 that are spaced from each other along a lateral direction A. The lateral direction A is oriented perpendicular to both the longitudinal direction L and the transverse direction T. Further, the lateral direction A can define the row direction 31. In accordance with the illustrated embodiment, the transverse direction T is oriented vertically, and the longitudinal and lateral directions L and A are oriented horizontally, though it should be appreciated that the orientations of the directions can vary during use of the electrical connector 20.

The connector housing 22 defines a mating interface 34 disposed proximate to the front end 30 and a mounting interface 36 disposed proximate to the bottom end 28. Thus, the electrical connector 20 can be configured as a right-angle connector. Alternatively, the electrical connector can be configured as a vertical connector whereby the mating interface 34 is disposed proximate to the front end 30, and the mounting interface 36 is disposed proximate to the rear end 32. The mounting interface 36 is configured to operatively engage the second substrate when the electrical connector 20 is mounted to the second substrate. The mating interface 34 is configured to operatively engage the at least one paddle card when the electrical connector 20 is mated with the at least one paddle card. In particular, the connector housing 22 defines at least one receptacle such as a first or upper receptacle 25*a* and a second or lower receptacle 25*b* that is spaced from the first or upper receptacle 25*a* along the transverse direction T. The receptacles 25*a* and 25*b* are disposed at mating interface 34, and configured to receive corresponding electrical components, such as the first and second paddle cards, respectively. Each of the receptacles 25*a* and 25*b* extends into the front end 30 of the connector housing 22. The first receptacle 25*a* extends along a first or upper row 27, and the second receptacle 25*b* extends along a second or lower row 29 that is spaced below the first or upper row 27 along the transverse direction T. Each of the first or upper row 27 and the second or lower row 29 are elongate along the row direction 31, and thus extend substantially parallel to each other. Each of the receptacles 25*a* and 25*b* extends into the front end 30, and is sized such that respective leading edges of the paddle cards are configured to be inserted into the receptacles 25*a* and 25*b*, respectively, of the first and second rows 27 and 29, respectively. Thus, the paddle cards can be described as vertically stacked when mated to the electrical connector 20.

With continuing reference to FIGS. 2-5C, the electrical connector 20 includes a plurality of leadframe assemblies 38 that each include a respective electrically insulative leadframe housing 40 and respective select ones of the plurality of electrical contacts 24 that are supported by the leadframe housing 40. The electrical contacts 24 supported by the leadframe housings 40 can be configured as signal contacts in accordance with the illustrated embodiment. Thus, the leadframe assemblies 38 can be referred to as signal leadframe assemblies. The plurality of leadframe assemblies 38 can be provided as insert molded leadframe assemblies (IMLAs) whereby the leadframe housing 40 is overmolded onto the respective electrical contacts 24. Alternatively, the electrical contacts 24 can be stitched into the leadframe housing 40. The leadframe assemblies 38 are supported by the connector housing 22 and arranged such that adjacent leadframe assemblies 38 are spaced along the row direction 31. For instance, the leadframe assemblies 38 can be supported by the second housing member 52.

The leadframe assemblies 38 can be spaced from each other along the lateral direction, and can include at least one first select leadframe assembly 38*a* of the plurality of leadframe assemblies 38, such as a plurality of first select leadframe assemblies 38*a* of the leadframe assemblies 38, and at least one second select leadframe assembly 38*b* of the plurality of leadframe assemblies 38, such as a plurality of second select leadframe assemblies 38*b* of the plurality of leadframe assemblies 38. The first assemblies 38 can be arranged in leadframe pairs that each includes one of the first select leadframe assemblies 38*a* and one of the second select leadframe assemblies 38*b* that are disposed adjacent to each other along the row direction 31. Aligned contacts 24 of the adjacent leadframe assemblies 38 along the row direction 31 define differential signal pairs. Otherwise stated, adjacent electrical contacts 24 of the respective leadframe pairs define differential signal pairs. Thus, because the electrical contacts 24 of the pairs of adjacent leadframe assemblies 38 whose broadsides face each other define differential signal pairs, the electrical contacts 24 can be said to be broadside-coupled. Furthermore, because adjacent electrical contacts 24 along the row direction 31 define differential signal pairs, the electrical connector 20 can be referred to as a row-based electrical connector.

Each of the respective electrical contacts 24 of each leadframe assembly 38 defines a mating portion 42 that extends laterally forward from the corresponding leadframe housing 40. Each of the respective electrical contacts 24 of each leadframe assembly 38 further defines a mounting portion 44 that extends down from the corresponding leadframe housing 40. The mating portions 42 are configured to electrically mate with a complementary one of the paddle cards. The mounting portions 44 can be configured as mounting tails that can be press-fit into complementary apertures extending into or through the third substrate. Alternatively, the mounting portions 44 can be configured to be surface mounted to the respective third substrate, or otherwise mounted to the third substrate as desired so as to place the electrical contacts 24 in electrical communication with corresponding electrical traces of the third substrate. Thus, the electrical connector 20 can be mated with at least one paddle card, such as first and second substrates paddle cards, so as to place the third substrate in electrical communication with at the least one paddle card to which the electrical connector 20 is mated.

The leadframe assemblies 38 can include as many electrical contacts 24 as desired that are spaced along a column direction 35 that is perpendicular to the row direction 31. The column direction 35 can be oriented along the transverse direction T. In accordance with the illustrated embodiment, each leadframe assembly 38 defines at least one pair of electrical contacts 24. For example, each leadframe assembly 38 can define a first or upper pair 24*a* of electrical contacts 24, and a second or lower pair 24*b* of electrical contacts 24. Each pair 24*a* and 24*b* can be defined by a first electrical contact 24' and a second electrical contact 24". When the leadframe assemblies 38 are supported by the connector housing 22, the mating portions 42 of the respective first and second electrical contacts 24' and 24" can be disposed at opposite ends of a respective receptacle with respect to the transverse direction T. For instance, the mating portions 42 of the first and second electrical contacts 24' and 24" of the upper pair 24*a* extend into the first receptacle 25*a* that is elongate along the upper row 27, and the mating portions 42 of the first and second electrical contacts 24' and 24" of the lower pair 24*b* extend into the second receptacle 25*b* that is elongate along the lower row 29. Further, the electrical connector 20 can define air pockets between the front end of the first housing member 51, and the mating portions 42.

The mating portions 42 of each of the first and second electrical contacts 24' and 24" of the upper pair 24*a* are spaced apart along the transverse direction T in the first receptacle 25*a*, and are placed in electrical communication with opposed upper and lower surfaces of the first paddle card when the first paddle card is inserted into the upper receptacle 25*a*. The mating portions 42 of each of the first and second electrical contacts 24' and 24" are spaced apart along the transverse direction T in the lower receptacle 25*b*, and are placed in electrical communication with opposed surfaces of the second paddle card when the second paddle card is inserted into the lower receptacle 25*b*. In this regard, the mating portions 42 of first and second ones of the electrical contacts 24 of a corresponding leadframe assembly 38 define at least one substrate-receiving gap that is configured to receive a paddle card paddle card in electrical communication with the third substrate. For instance, the mating portions 42 of the first and second electrical contacts 24' and 24" of the upper pair 24*a* define a first substrate-receiving gap 33*a* that is configured to receive the first paddle card such that the mating portions 42 of the first and second electrical contacts 24' and 24" of the upper pair 24*a* engage opposed surfaces of the first paddle card. The mating portions 42 of each of the first and second electrical contacts 24' and 24" of the lower pair 24*b* define a second substrate-receiving gap 33*b* that is configured to receive the second paddle card such that the mating portions 42 of each of the first and second electrical contacts 24' and 24" of the lower pair 24*b* engage opposed surfaces of the second paddle card.

The respective electrical contacts 24 of adjacent leadframe assemblies 38, for instance electrical contacts 24 that are aligned along the row direction 31, can define differential signal pairs. In accordance with the illustrated embodiment, the first electrical contact 24' of the upper pair 24*a* of a first one of the leadframe assemblies 38 and the first electrical contact 24' of the upper pair 24*a* of a second one of the leadframe assemblies 38 that is adjacent the first one of the leadframe assemblies 38 can define a respective differential signal pair. Furthermore, the second electrical contact 24" of the upper pair 24*a* of the first one of the leadframe assemblies 38 and the second electrical contact 24" of the upper pair 24*a* of the second one of the leadframe assemblies 38 can define a respective differential signal pair. Further still, the first electrical contact 24' of the lower pair 24*b* of the first one of the leadframe assemblies 38 and the first electrical contact 24' of the lower pair 24*b* of the second one of the leadframe assemblies 38 can define a respective differential signal pair. Further still, the second electrical contact 24" of the lower pair 24*b* of the first one of the leadframe assemblies 38 and the second electrical contact 24" of the lower pair 24*b* of the second one of the leadframe assemblies 38 can define a respective differential signal pair. The first ones of the leadframe assemblies 38 can be defined by the first select leadframe assemblies 38*a*. The second ones of the leadframe assemblies 38 can be defined by the second select leadframe assemblies 38*b*.

The leadframe housings 40 the first and second ones of the leadframe assemblies 38 of each pair of leadframe assemblies 38 can attach to each other in any suitable manner as desired. Each leadframe housing 40 defines a first side 43*a* and a second side 43*b* that is opposite the first side with respect to the lateral direction A. The first and second sides 43*a* and 43*b* of the leadframe housings 40 can also define first and second sides of the respective leadframe assemblies 38. In each pair of leadframe assemblies 38, the first sides 43*a* define inner sides that face each other, and the second sides 43*b* define outer sides that face away from each other. The first side of each of the first and second ones of the leadframe assemblies 38 of each pair defines at least one of an opening 60 and a projection 62 that are configured to mate with each other so as to attach the first and second ones of the leadframe assemblies 38 to each other. In one example, the first side of each of the first and second ones of the leadframe assemblies 38 of each pair defines both at least one opening 60 and at least one projection 62. At least one of the projections 62 can be configured as an elongate rib 64. Alternatively or additionally, at least one of the projections can be localized, that is not elongate. For instance, the at least one of the projections can be cylindrical in shape. It should be appreciated, of course, that the projections 62 can have any suitable size and shape as desired. Similarly, at least one of the openings 60 can be elongate so as to receive the elongate rib 64. Alternative or additionally, at least one of the openings 60 can be localized, that is not elongate, and thus configured to receive the localized projection 62. When the openings receive the projections, the first and second ones of the leadframe assemblies 38 are coupled such that the respective one of the electrical contacts 24 of the first and second ones of the leadframe assemblies 38 are aligned with each other along the lateral direction A. In one example, the ribs 64 can be press fit into the openings 60.

Because the mating portions 42 of the upper and lower pairs 24*a* and 24*b* of the electrical contacts 24 are arranged so as to receive the first and second paddle cards, respectively, the electrical contacts 24 can be referred to as receptacle contacts and the electrical connector 20 can be referred to as a receptacle connector. Furthermore, because the mating portions 42 of the electrical contacts 24 are oriented substantially perpendicular with respect to the mounting portions 44, the electrical connector 20 can be described as a right-angle connector. Alternatively, the electrical connector 20 can be configured as a vertical connector whose mating portions 42 are oriented substantially parallel with respect to the mounting portions 44. For instance, the mounting portions 44 can extend rearward from the rear ends of the leadframe housings 40.

With continuing reference to FIGS. 2-5C, the grounds 41 include respective ground mating portions 72 and respective ground mounting portions 74 opposite the ground mating portions 72 and in electrical communication with the ground mating portions 72, as described in more detail below. The grounds can be configured as ground plates 46. The ground plates 46 can be electrically conductive. For instance, the ground plates 46 can be metallic. Alternatively, the ground plates 46 can be electrically absorptive. For instance, the ground plates 46 can be made from an electrically absorptive lossy material. Thus, the ground plates 46 can be made from a metallic or non-metallic material. Each ground plate 46 can be oriented in a vertical plane that is defined by the transverse T and lateral A directions, and extend vertically and laterally a sufficient distance so as to overlap at least part up to all of at least one up to all of the adjacent electrical contacts 24 with respect to the row direction 31. Thus, a line extending along the row direction 31 passes through at least one of the electrical contacts 24 of the leadframe assembly 38 that is adjacent the ground plate 46 along the row direction 31, and further passes through the ground plate 46. The leadframe assemblies 38 and the ground plates 46 can be supported by the connector housing 22 and arranged such that the ground plates 46 are disposed between respective ones of the leadframe assemblies 38. For instance, the ground plates 46 can be disposed between adjacent pairs of leadframe assemblies 38 that are defined by the first and second ones of leadframe assemblies 38 described above. Accordingly, a line extending along the row direction 31 that passes through a broadside coupled differential signal pair of electrical contacts 24 of a corresponding leadframe pair can pass through the ground plate 46 after passing through the differential signal pair. Thus, the ground plates 46 can define metallic electromagnetic shields that are disposed between at least one pair of differential signal pairs defined by the adjacent leadframe pairs. The ground plates 46 and the leadframe assemblies, when attached to each other, can define a leadframe block.

Furthermore, at least one of the ground plates 46 up to all of the ground plates 46 can define a plurality of mating portions 72 that can be aligned with the mating portions 42 of respective of the electrical contacts 24 along the row direction 31. In accordance with the illustrated embodiment, the mating portions 72 can be configured as fingers that project forward from the respective ground plates 46 along the longitudinal direction L. The mating portions 72 can be shaped substantially identically with the aligned mating portions 42 of the electrical contacts 24 as illustrated, or can be shaped differently as desired. In accordance with the illustrated embodiment, each ground plate 46 defines at least one pair of mating portions 72, such as a first or upper pair 72*a* of mating portions 72 and a second or lower pair 72*b* of mating portions that are electrically commoned, or electrically connected, together via the respective ground plate 46. Thus, an electrical path is established between each of the mating portions 72 through the ground plate 46. For instance, each pair 72*a* and 72*b* of mating portions 72 can include a first mating portion 72' and a second mating portion 72". When the ground plates 46 are supported by the connector housing 22, each of the first and second mating portions 72' and 72" of the upper pair 72*a* can extend into the upper receptacle 25*a* that is elongate along the first row 27, and the each of the first and second mating portions 72' and 72" of the lower pair 72*b* extend into the lower receptacle 25*b* that is elongate along the second row 29. Thus, the mating portions 72 of the upper pair 72*a* can be aligned with the mating portions 42 of the electrical contacts 24 of the upper pair 24*a* along the row direction 31, and can be shaped substantially identically to the mating portions 42 of the electrical contacts 24 of the upper pair 24*a* of each leadframe assembly 38. Likewise, the mating portions 72 of the lower pair 72*b* are aligned with the mating portions 42 of the electrical contacts 24 of the lower pair 24*b* along the row direction 31, and can be shaped substantially identically to the mating portions 42. Further, the electrical connector 20 can define air pockets between the front end of the first housing member 51, and the ground mating portions 72.

As described above, the first and second ones of the leadframe assemblies 38 of each pair of leadframe assemblies 38 can define respective second sides 43*b* that face away from the respective first sides 43*a*. The second side 43*b* of the second one of the leadframe assemblies 38 can attach to the ground member 41, such that the ground member 41 is disposed between adjacent pairs of leadframe assemblies 38. For instance, the ground plate 46 can be disposed between the second side 43*b* of the second one of the leadframe assemblies 38 of a first pair of leadframe assemblies 38, and the second side of the first one of the leadframe assemblies of a second pair of leadframe assemblies 38. As described above, the first and second ones of the leadframe assemblies 38 can be alternatingly arranged along the lateral direction A.

The second sides 54*b* of the second ones of the leadframe assemblies 38 can attach to the respective ground members 41 in any suitable manner as desired. For instance, the second ones of the leadframe assemblies 38 can attach to the ground member 41 at least at one attachment location. In one example, the second ones of the leadframe assemblies 38 can define at least one projection 62, such as a plurality of projections 62, that extend from the second side 43*b*. The ground member 41 can define complementary openings 60 that are configured to receive the projections 62, thereby attaching the ground member 41 to the leadframe assembly 38. When the ground member 41 is attached to the leadframe assembly 38, the ground mating ends 72 are aligned with respective ones of the mating ends 42 of the leadframe assembly 38 along the lateral direction Al. Alternatively, the second sides 43 of the first ones of the leadframe assemblies 38 can be configured to attach to the ground plates 38 as desired.

During operation of the electrical connector 20, the upper receptacle 25*a* is configured to receive the first paddle card, such that a first surface of the first paddle card is placed in electrical communication with both 1) the first mating portions 72' of the upper pair 72*a*, and 2) the mating portion 42 of the first electrical contacts 24' of the upper pair 24*a* of electrical contacts 24. Similarly, a second surface of the first paddle card is placed in electrical communication with both 1) the second mating portions 72" of the upper pair 72*a*, and 2) the mating portion 42 of the second electrical contacts 24" of the upper pair 24*a* of electrical contacts 24 Likewise, during operation of the electrical connector 20, the lower receptacle 25*b* is configured to receive the second paddle card, such that a first surface of the second paddle card is placed in electrical communication with both 1) the first mating portions 72' of the lower pair 72*b*, and 2) the mating portion 42 of the first electrical contacts 24' of the lower pair 24*b* of electrical contacts 24. Similarly, a second surface of the second paddle card is placed in electrical communication with both 1) the second mating portions 72" of the lower pair 72*b*, and 2) the mating portion 42 of the second electrical contacts 24" of the lower pair 24*b* of electrical contacts 24. The first and second surfaces of the paddle cards are opposite each other along the transvers direction T.

At least one of the ground plates 46 up to all of the ground plates 46 can further define a plurality of mounting portions 74 opposite the ground mating portions 72. The ground mounting portions can be configured as mounting tails that project down from the respective ground plates 46 and are configured to be press-fit into apertures of the third substrate. Alternatively, the mounting portions 74 can be surface mounted to the third substrate. The mounting portions 74 are electrically commoned together and further electrically commoned with the mating portions 72 via the ground plate 46. Thus, each of the ground plates 46 establishes an electrical path between the respective ground mounting portions 74 and the ground mating portions 72. Thus, the ground plates 46 define ground contacts that are connected between the third substrate and at least one paddle card, such as the first and second paddle cards. Each of the ground plates 46 can be overmolded by a ground leadframe housing to define a ground leadframe assembly as desired.

Figure 2:
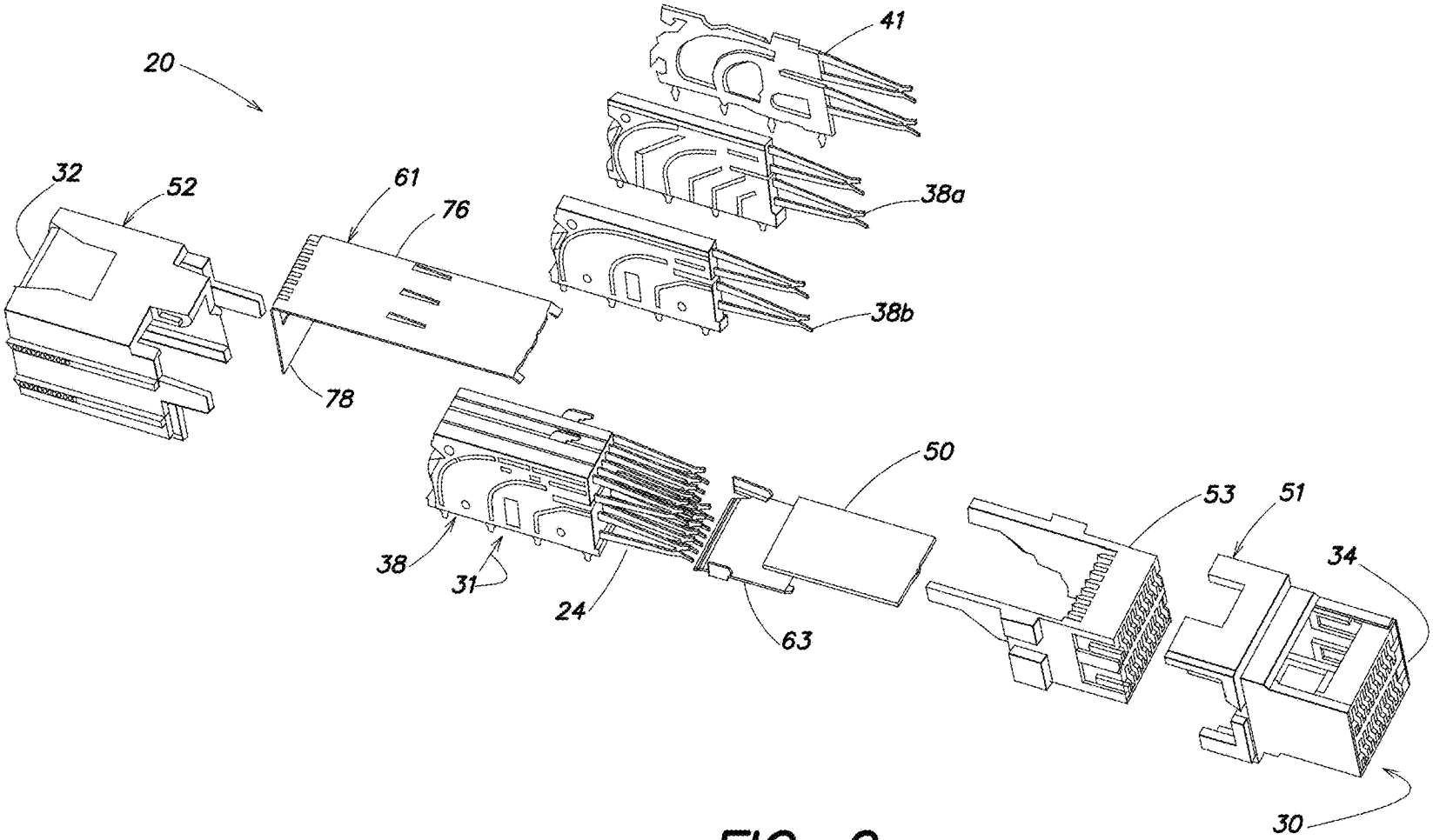
FIG. 2 is an exploded assembly view of the electrical connector illustrated in FIG. 1A.
Figure 3:
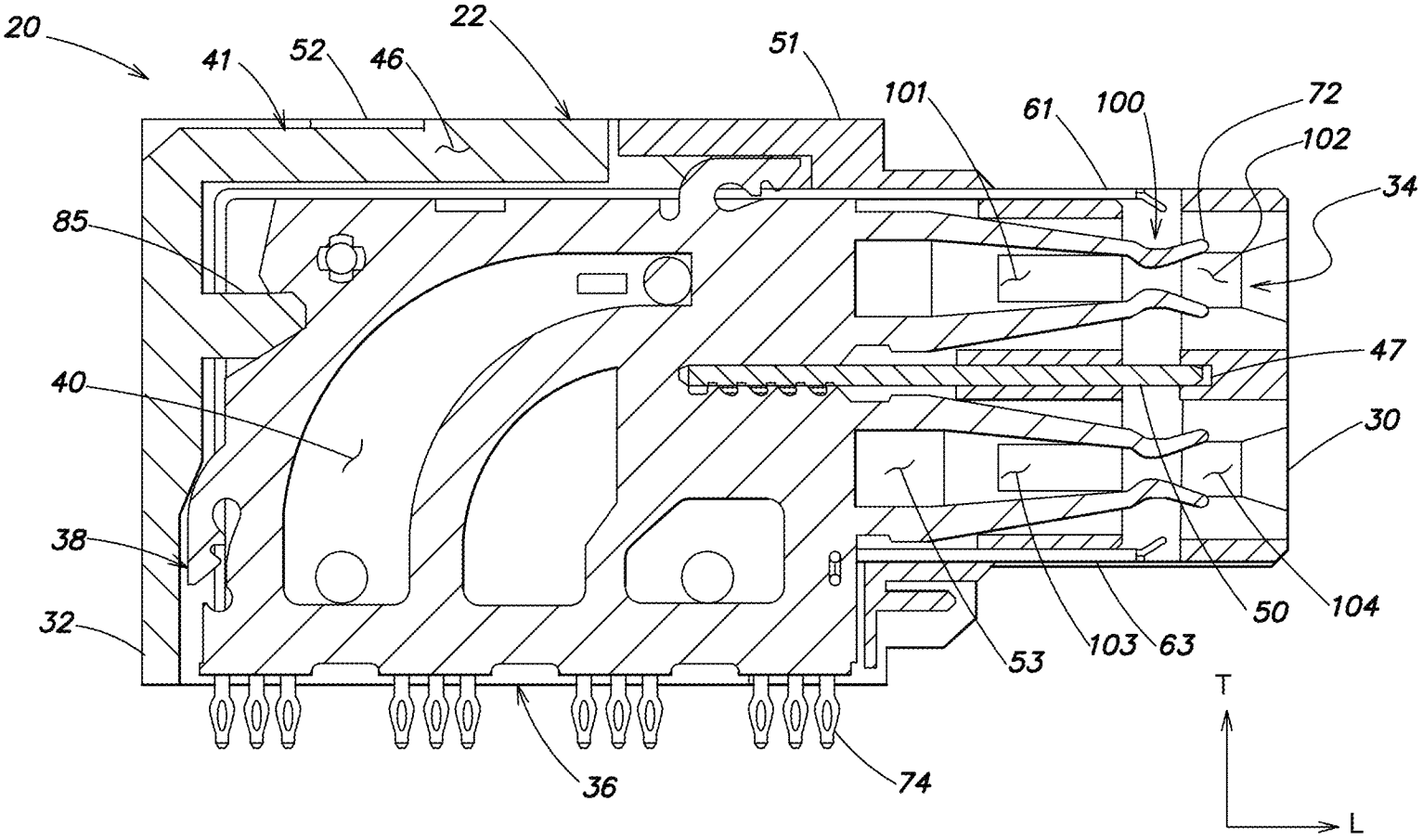
FIG. 3 is a sectional side elevation view of the electrical connector illustrated in FIG. 1A.
Figure 4A:
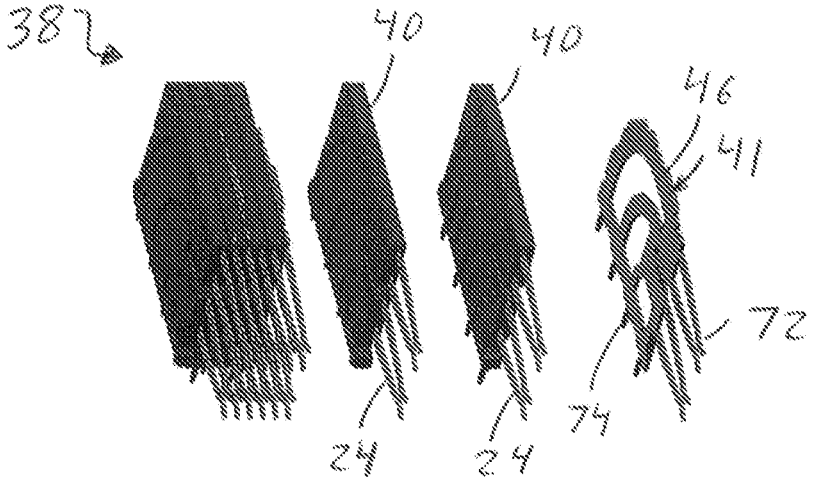
FIG. 4A is a perspective assembly view of a leadframe block of the electrical connector illustrated in FIG. 1A.
Figure 4B:
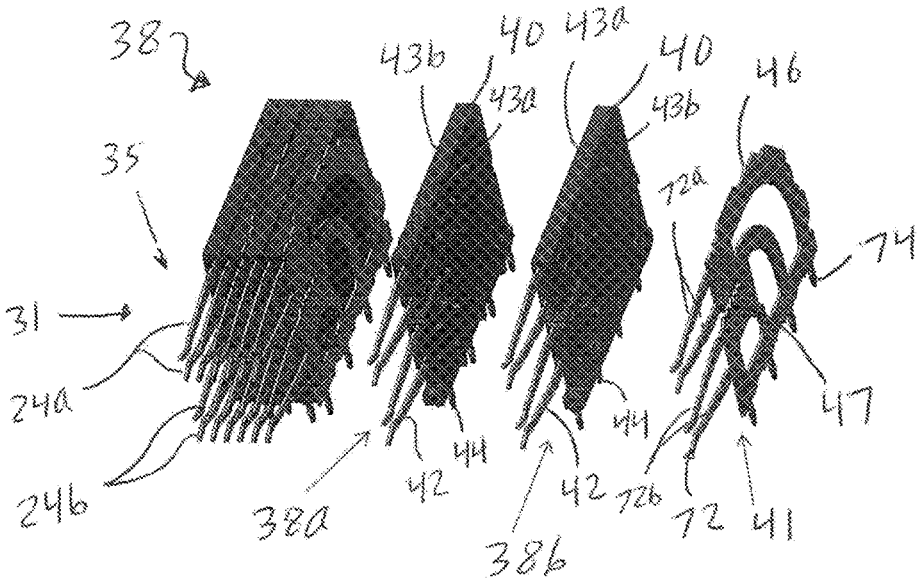
FIG. 4B is another perspective assembly view of a leadframe block of the electrical connector illustrated in FIG. 4A.
Figure 5A:
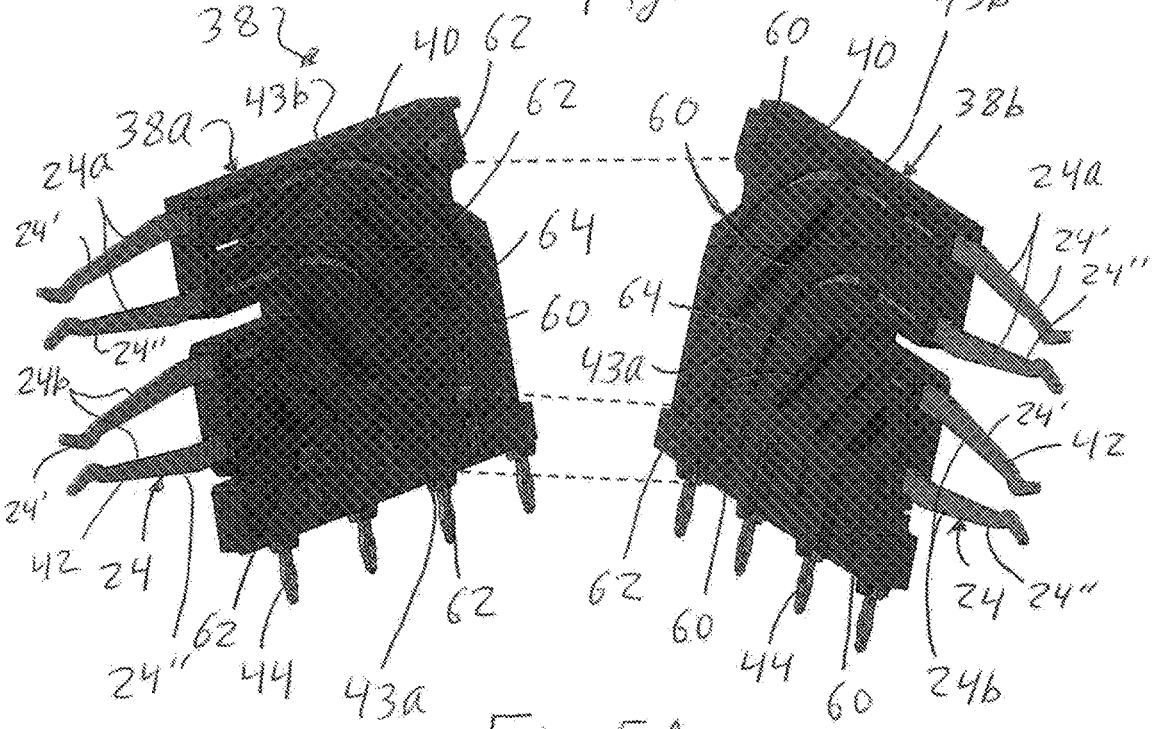
FIG. 5A is a perspective view of a pair of leadframe assemblies of the leadframe block illustrated in FIG. 4.
Figure 5B:
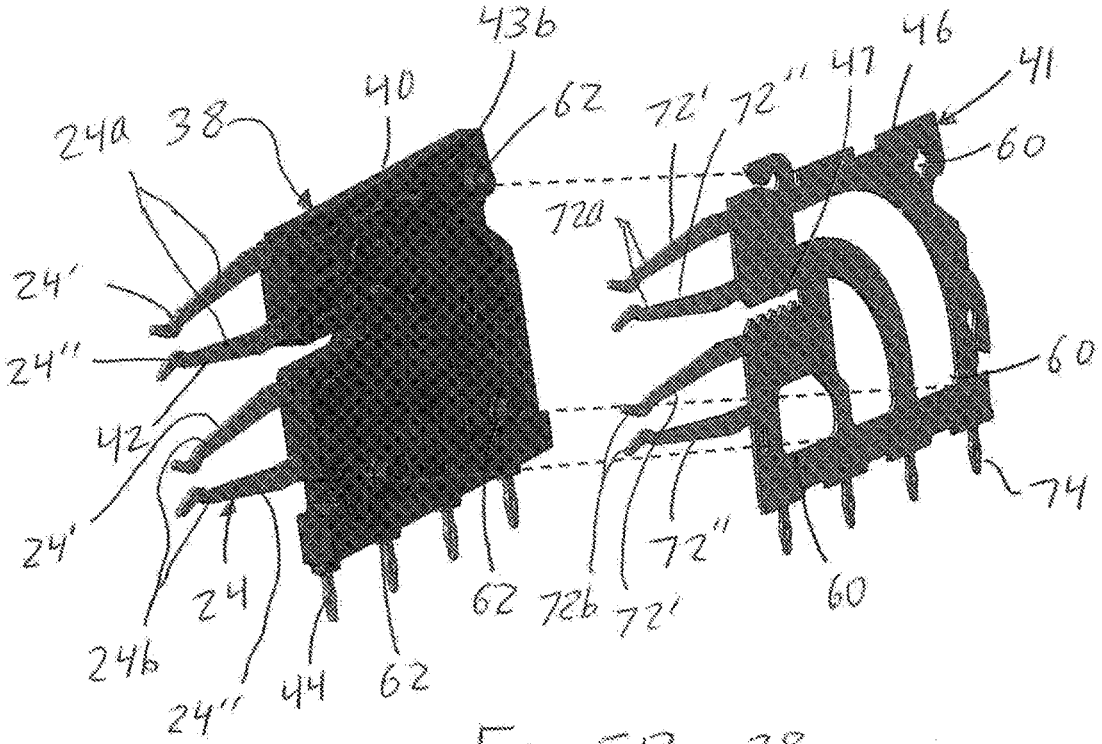
FIG. 5B is a perspective view of the pair of leadframe assemblies illustrated in FIG. 5A, shown during attachment to a ground leadframe.
Figure 5C:
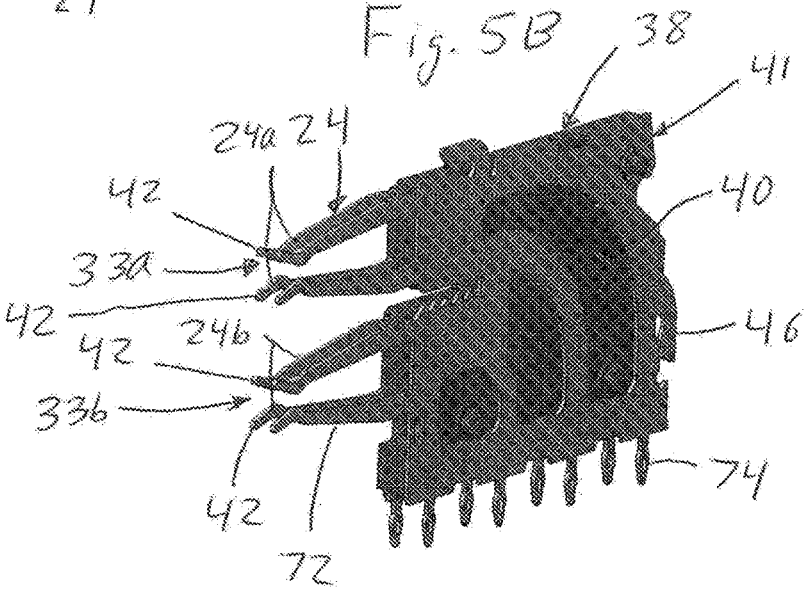
FIG. 5C is a perspective view of the pair of leadframe assemblies illustrated in FIG. 5B, shown attached to the ground leadframe.

Further, referring to FIGS. 2-3, each of the ground plates 46 can include opposed surfaces that define a slot 47 configured to receive a front ground shield 50 that is in contact with each of the ground plates 46, and electrically isolated from the electrical contacts 24. For instance, the front ground shield 50 can be received in the slots 47 that extend rearwardly into the front ends of the ground plates 46. Thus the front ground shields 50 are retained in the ground plates 46 in contact with the ground plates 46. The front ground shield 50 can be electrically conductive so as to place all ground plates 46 that support the front ground shield 50 in electrical communication with each other. Thus, the front ground shield 50 can be metallic. The front ground shield 50 is spaced from the electrical contacts 24 so as to be electrically isolated from the electrical contacts 24. As shown in FIG. 3, the front end of the front ground shield 50 can be extend into the first housing member 51 so as to be supported by the first housing member 51, and the rear end of the front ground shield 50 can be received in the slots 47 of the ground plates 46. The front ground shield 50 is described in more detail as a ground commoning member in U.S. Pat. No. 8,280,413, the disclosure of which is hereby incorporated by reference as if set forth in its entirety herein.

Referring now to FIGS. 2 and 6A-7, the electrical connector 20 further includes a top ground shield 61 and a bottom ground shield 63. The shields are disposed such that at least a portion of the front ground shield 50 is disposed between at least a portion of the top ground shield 61 and the bottom ground shield 63 with respect to the transverse direction T. For instance, an entirety of the front ground shield 50 can be disposed between a portion of the top ground shield 61 and an entirety of the bottom ground shield 63 with respect to the transverse direction T. The top ground shield 61 can be in contact with the ground members 41. Similarly, the bottom ground shield 63 can be in contact with the ground members 41. Thus, the top ground shield 61, the bottom ground shield 63, the front ground shield 50, and the ground members 41 can all be in electrical communication with each other. The top ground shield 61, the lower ground shield, and the front ground shield 50 can be electrically conductive. For instance, they can be metallic. Alternatively, they can be electrically absorptive. For instance, they can be made from an electrically absorptive lossy material. Thus, the ground plates 46 can be made from a metallic or non-metallic material.

Figure 6A:
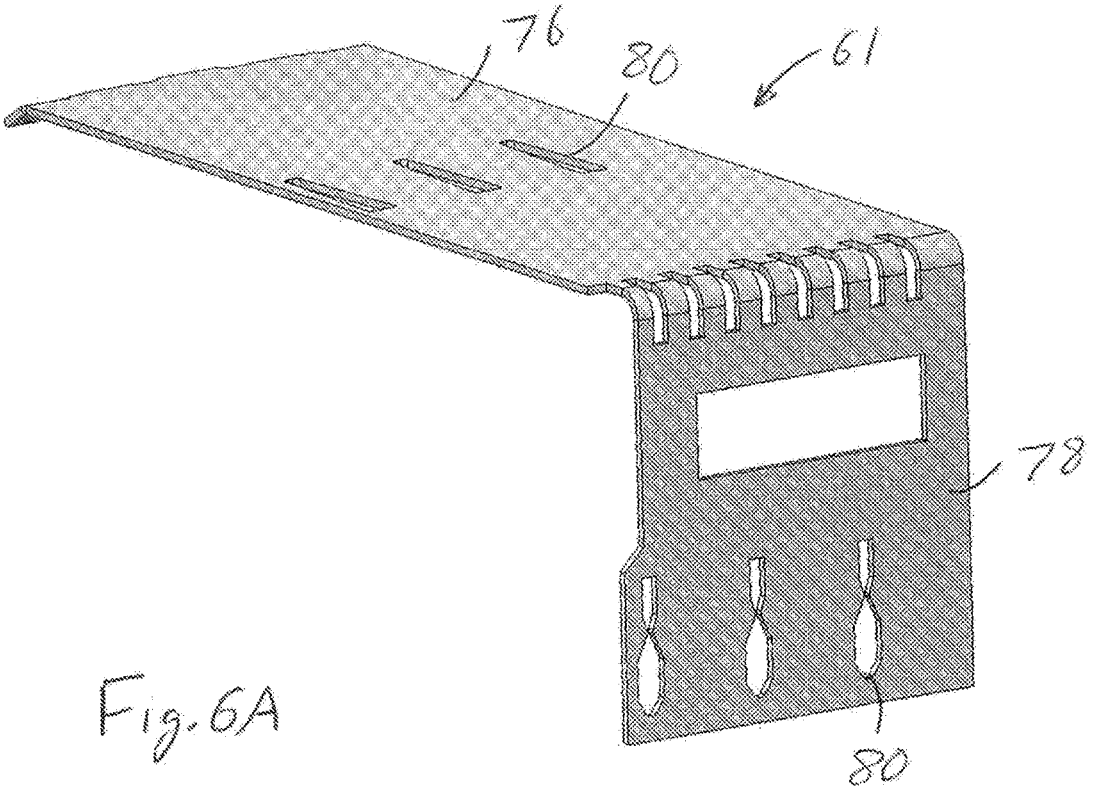
FIG. 6A is a perspective view of a top ground shield of the electrical connector illustrated in FIG. 1A.
Figure 6B:
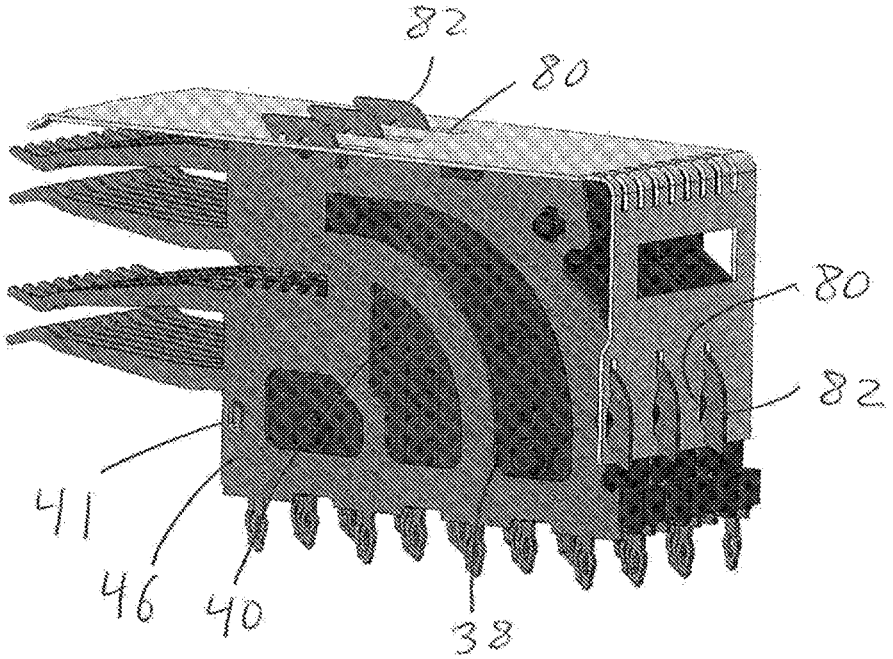
FIG. 6B is a perspective view of the top ground shield illustrated in FIG. 6A attached to the leadframe block illustrated in FIG. 4.
Figure 6C:
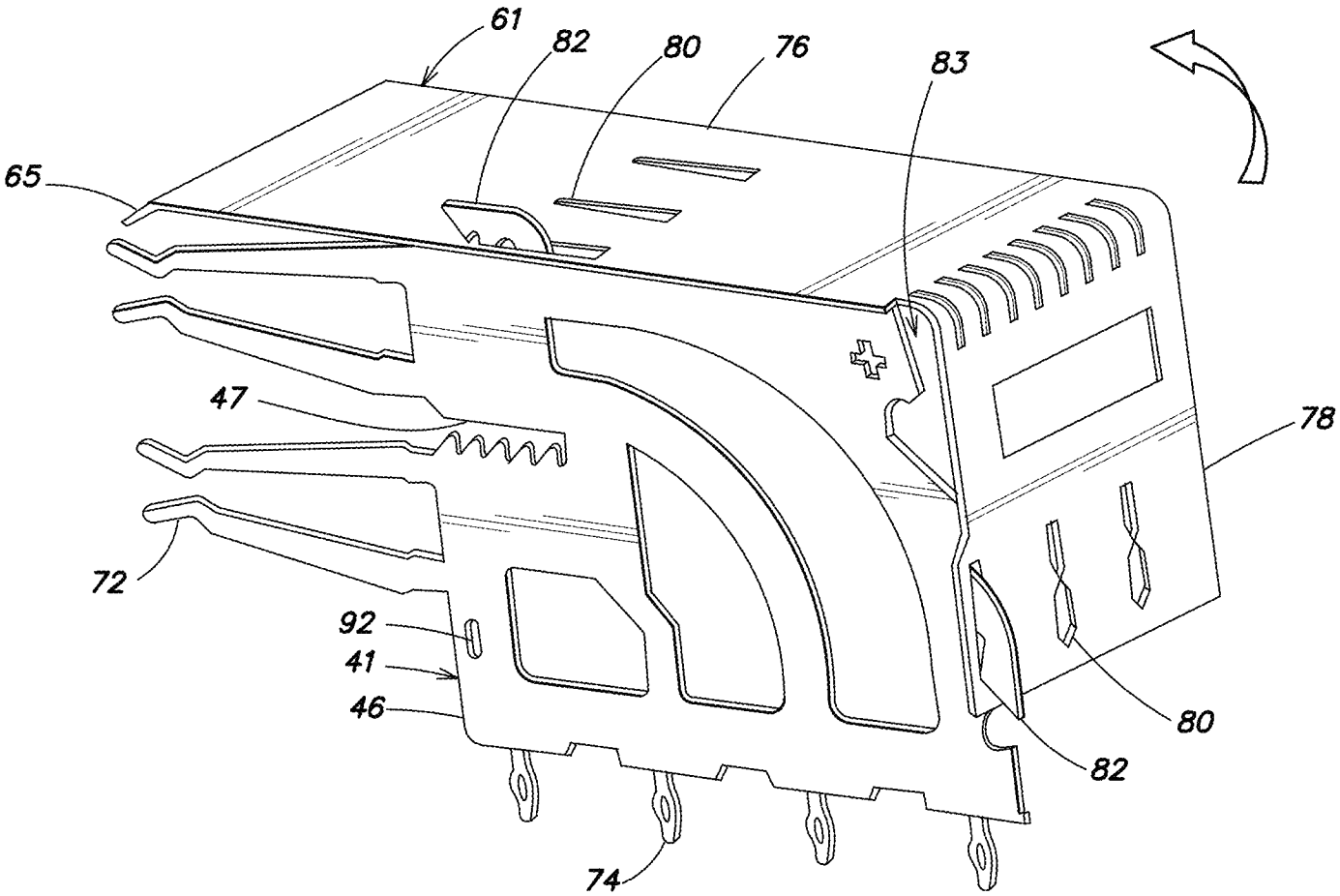
FIG. 6C is a detailed perspective view of the top ground shield illustrated in FIG. 6B shown attached to one of the ground plates of the leadframe block illustrated in FIG. 4.
Figure 7:
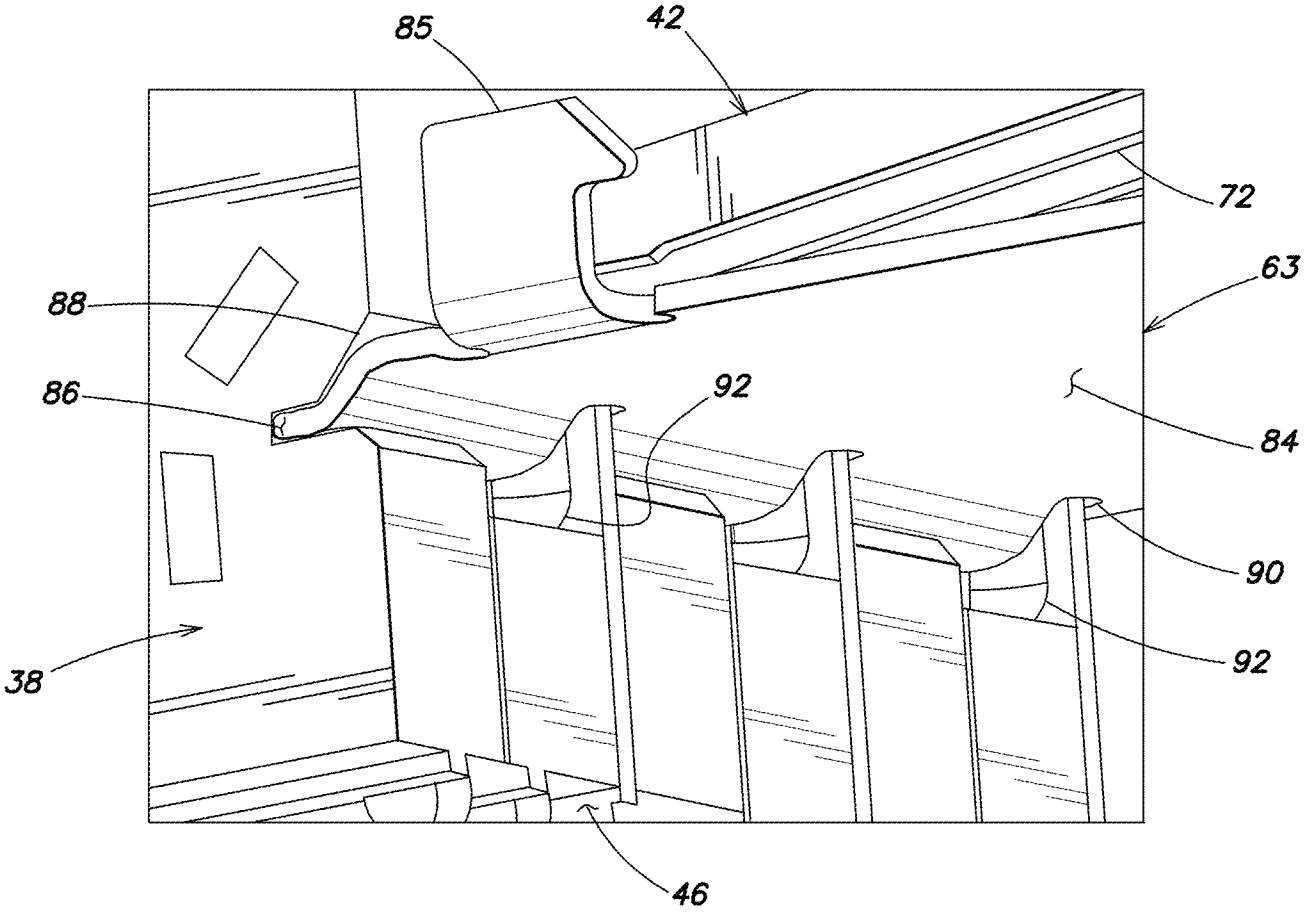
FIG. 7 is a perspective view of a portion of a lower ground shield of the electrical connector illustrated in FIG. 1A, shown attached to the leadframe block illustrated in FIG. 4.
Figure 8A:
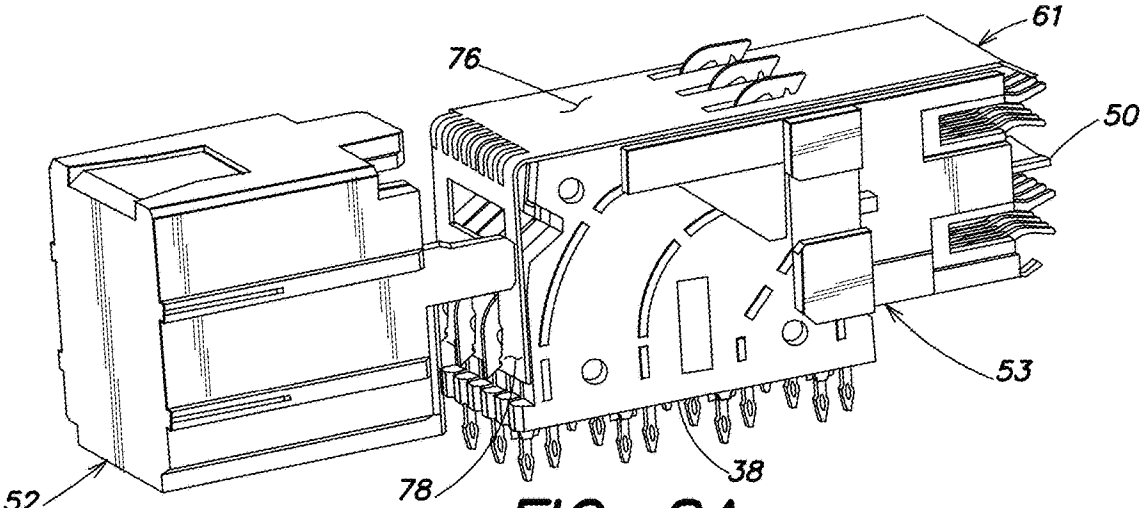
FIG. 8A is a perspective assembly view of the electrical connector illustrated in FIG. 1A; showing attachment of a rear housing to a leadframe stack that includes the leadframe block of FIG. 4, the top ground shield illustrated in FIG. 6A attached to the leadframe block, and the lower ground shield illustrated in FIG. 7 attached to the leadframe block.
Figure 8B:
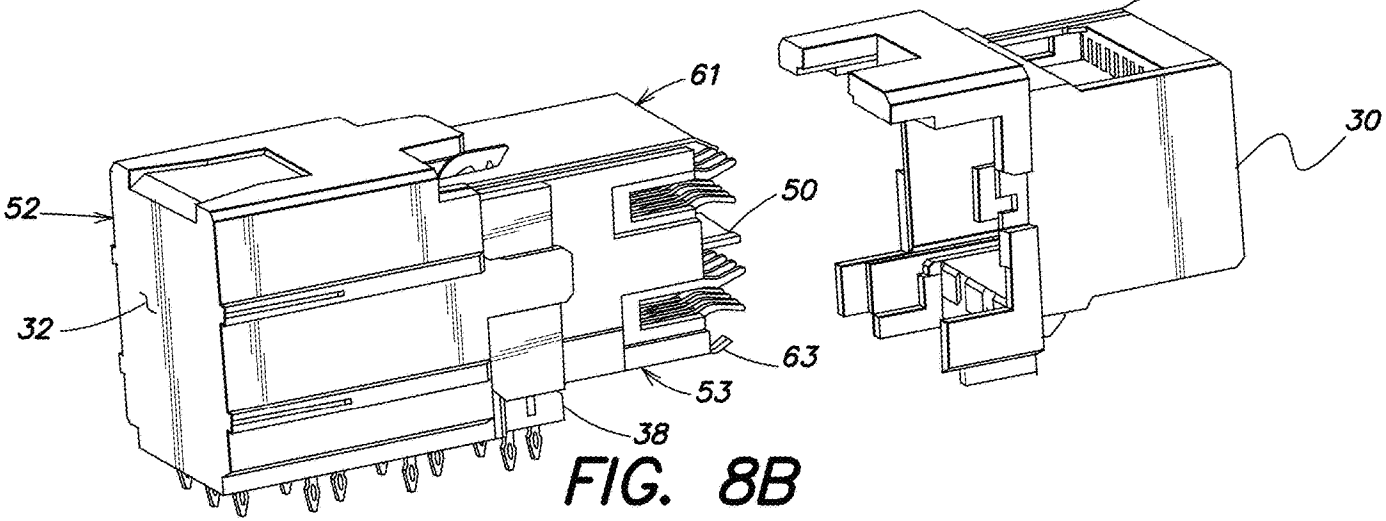
FIG. 8B is a perspective assembly view of the electrical connector illustrated in FIG. 1A, showing attachment of a front housing to the rear housing illustrated in FIG. 8A.

The top ground shield 61 can include an upper portion 76 that can be oriented in a plane defined by the longitudinal direction L and the lateral direction A. The top ground shield 61 can further include a rear portion 78 that extends from the upper portion 76 along a downward direction, such that the rear portion 78 is disposed rearward of at least a portion of the leadframe assemblies 38 and aligned with at least a portion of the leadframe assemblies 38 along the longitudinal direction L. The top ground shield 61 can define a pair of projections that extend forward and down from the front end of the upper portion 76. The top ground shield 61 can attach to the ground members 41 at either or both of the upper portion 76 and the rear portion 78. For instance, as illustrated in FIGS. 6A-6C, the top ground shield 61 can define at least one slot 80 that extends through at least one of the upper portion 76 and the rear portion 78. Each of the ground members 41 can include at least one tab 82 that is configured to extend through the respective at least one slot 80 so as to attach the top ground shield 61 to the ground members 41, and place the top ground shield 61 in electrical communication with each of the ground members 41. In accordance with the illustrated embodiment, each of the ground members 41 can include a tab 82 that extends out the rear and the top of the respective ground plate 46. Correspondingly, the top ground shield 61 can include slots 80 in the upper portion 76 and the rear portion 78. The top ground shield 61 can be attached to the ground members 41 by first inserting the tabs 82 of the rear of the ground plates 46 into the respective slots 80 in the rear portion 78, then rotating the top ground shield 61 such that the slots 80 in the upper portion 76 receive the tabs 82 that extend from the top of the ground plates 46. The upper end of the rear of the ground plates 46 can define a cut-out 83 so as to provide clearance for rotation of the top ground shield 61 during attachment to the ground members 41. Further, the cut-out 83 can receive a projection 85 of the second housing member 52 (see FIG. 3).

Referring now to FIGS. 2, 6C, 7, and 8A-B, the bottom ground shield 63 can be disposed such that at least respective portions of the mating portions 42 of the electrical contacts 24 and the ground mating portions 72 are disposed between the bottom ground shield 63 and the top ground shield 61. The bottom ground shield 63 can include a bottom plate 84, and an attachment member 85 that extends out from the plate 84. The attachment member 85 can be configured as a tab that engages and attaches to the inner housing member 53. The bottom ground shield 63 can further define a rear end 86 that is inserted into a slot that extends into channels 88 that extend into the front ends of the leadframe housings 40. Thus, the bottom ground shield 63 can be supported by the leadframe housings 40. The top ground shield 61 can define a pair of projections (one of which can be seen at 65 in FIG. 6C) that extend forward and down from its the front end and can attach inside the inner housing member 53. The inner housing member 53 can nest inside the first housing member 51 when the electrical connector 20 is assembled.

The bottom ground shield 63 can include slots 90 that extend into the rear end 86 along the longitudinal direction L. The slots 90 can define a width along the lateral direction A that is sized to receive the front ends of the ground plates 46. Further, each of the ground plates 46 can define a bent region 92 that sits in the slots 90. The bent regions 92 can have a width along the lateral direction sufficient so as to contact a first inner surface of the bottom ground shield 63 that partially defines the slot 90. The leadframe housings 40 can define pockets that receive the bent regions 92 at the location that the bent region 92 contacts the bottom ground shield 63. Thus, the bent regions 92 can project out from a first side of the ground plates 46 along the lateral direction. In one example, the bent region 92 can be defined by an embossment in the ground plate 46. A second side of the ground plates 46 opposite the first side along the lateral direction A can seat against a second inner surface of the bottom ground shield 63 that is opposite the first inner surface and also at least partially defines the slot 90.

Referring again to FIG. 3, a cross-sectional view of the illustrative electrical connector 20 is shown, with the inner housing member 53 nested between the front housing member 51 and the rear housing member 52. In this view, a cross-section of the front housing member 51 is distinguished from a cross-section of the inner housing member 53 based on hatching. The front housing member 51 and the inner housing member 53, when assembled together, can form one or more cavities, such as cavities 100-105 shown in FIG. 3.

In some embodiments, one or more of the cavities 100-105 may be interconnected. For instance, in the example shown in FIG. 3, the cavity 100 may be elongated in the transverse direction T, and may interconnect the upper cavities 101-102 and the lower cavities 103-104. Additionally, or alternatively, the cavity 100 may be elongated in the lateral direction A, and may interconnect like cavities in the lateral direction A. However, that is not required, as in some embodiments some of the cavities 100-105 may be isolated from each other.

In some embodiments, the cavities 101-102 may be configured to receive a first paddle card, and the cavities 103-104 may be configured to receive a second paddle card. The inventors have recognized and appreciated that the cavity 100 may allow more air to be present in a mating region where the first and second paddle cards make electrical connections with electrical contacts of the connector 20. The increased presence of air, which is a dielectric material, may advantageously improve impedance matching at the mating region.

The increased air provided by cavity 100 may be positioned at any suitable location along the length of the electrical contacts 24. In some embodiments, the cavity 100 may be positioned to preferentially increase the amount of air surrounding mating surfaces of the electrical contacts 24. The mating surfaces are apparent, for example in FIG. 4A, as the arced surfaces of the beams of the electrical contacts 24.

The inventors have further recognized and appreciated that complex molding operations may be required to provide an air hole such as the cavity 100 in a desired location if the inner housing member 53 and the front housing member 51 were molded together as a single piece. By molding the inner housing member 53 and the front housing member 51 as separate pieces, an air hole such as the cavity 100 may be provided with simple molding operations. Furthermore, the top ground shield 61 and the bottom ground shield may advantageously be captured between the inner housing member 53 and the front housing member 51 without any complex overmolding operation.

Figure 9B:
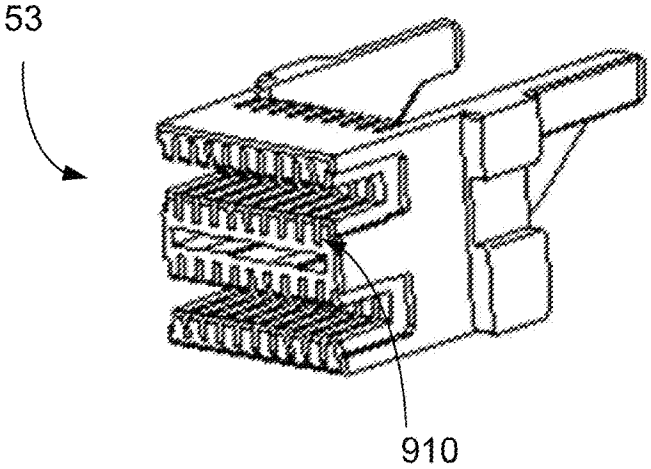
FIGS. 9A and 9B are front left and right side, respectively, perspective views of an inner housing member of the connector of FIG. 1A.
Figure 9A:
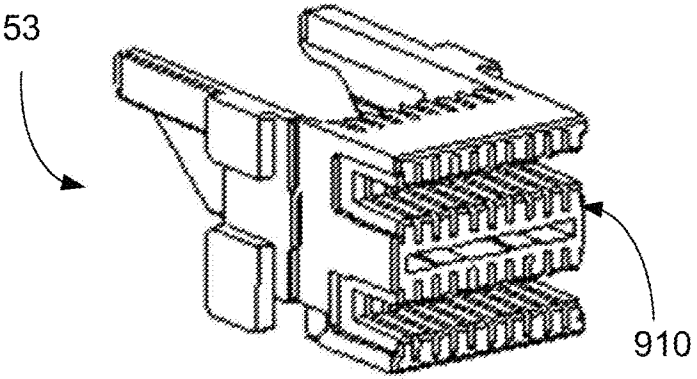
Figure 9D:
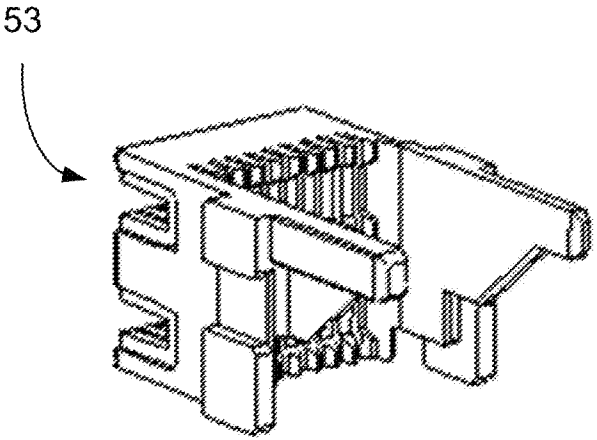
FIGS. 9C and 9D are rear right and left side, respectively, perspective views of an inner housing member of the connector of FIG. 1A.
Figure 9C:
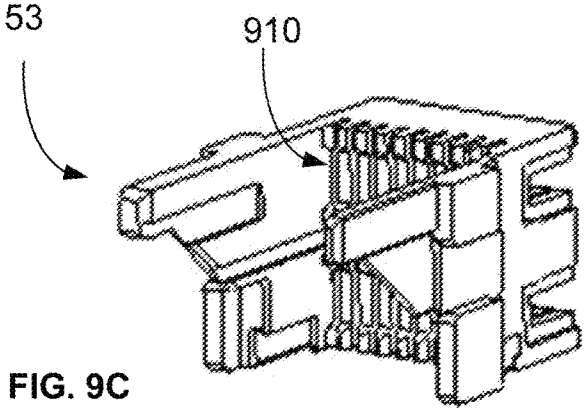
Figure 10B:
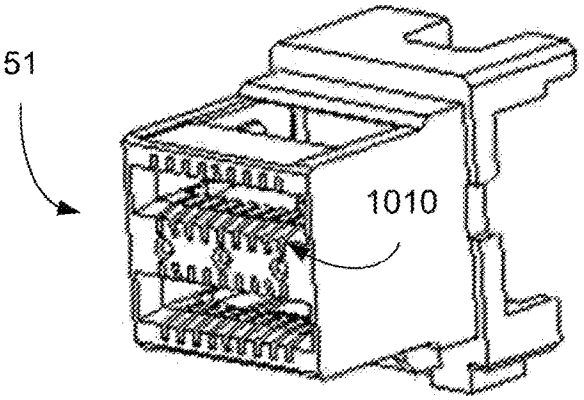
FIGS. 10A and 10B are front left and right side, respectively, perspective views of a front housing member of the connector of FIG. 1A.
Figure 10A:
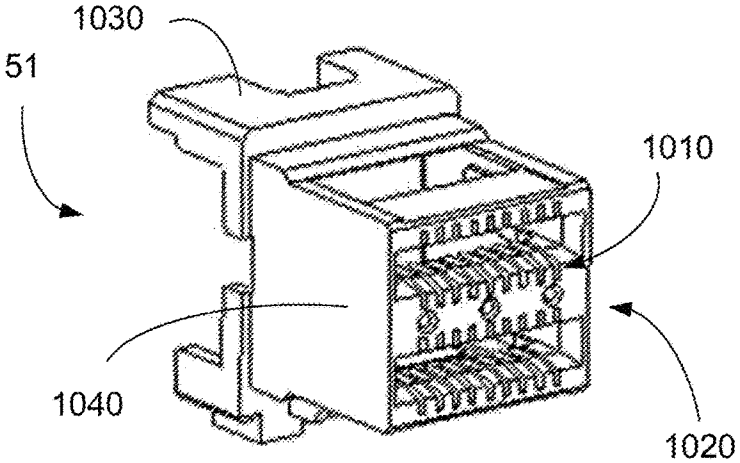
Figure 10D:
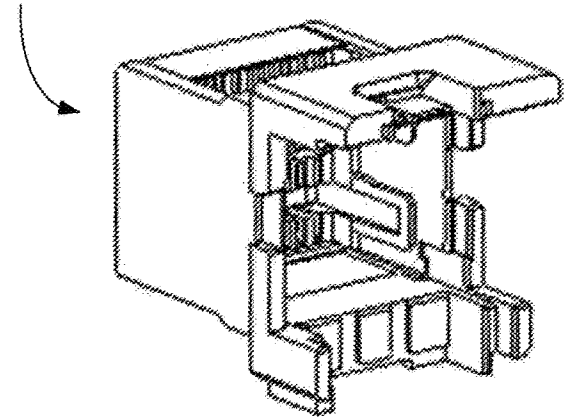
FIGS. 10C and 10D are rear right and left side, respectively, perspective views of a front housing member of the connector of FIG. 1A.
Figure 10C:
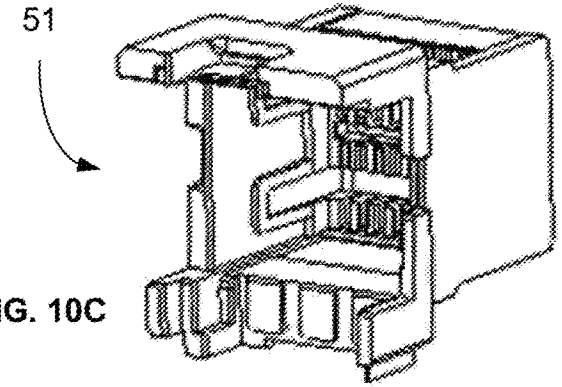
Figure 11B:
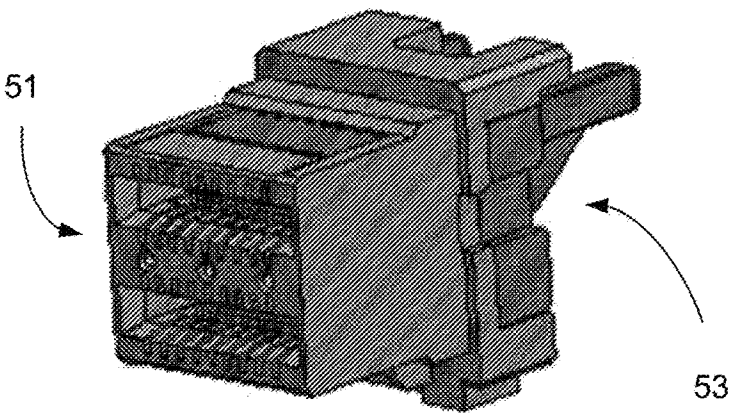
FIGS. 11A and 11B are front left and right side, respectively, perspective views of an inner housing member inserted in a front housing member of the connector of FIG. 1A.
Figure 11A:
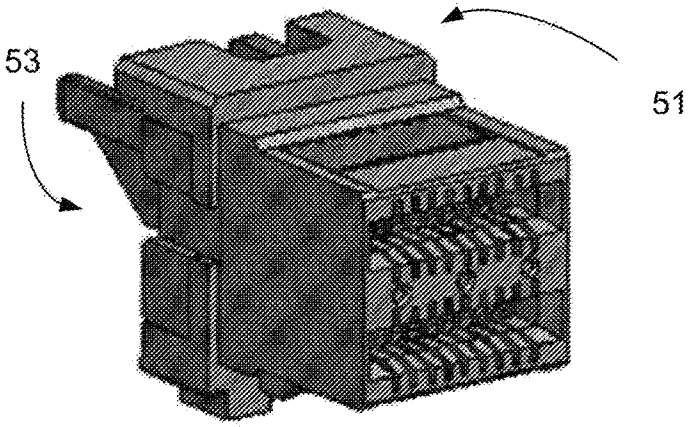
Figure 11D:
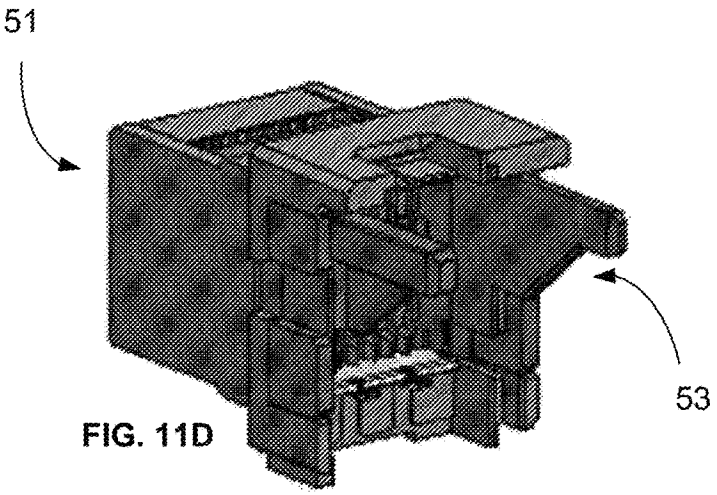
FIGS. 11C and 11D are rear right and left side, respectively, perspective views of an inner housing member inserted in a front housing member of the connector of FIG. 1A.
Figure 11C:
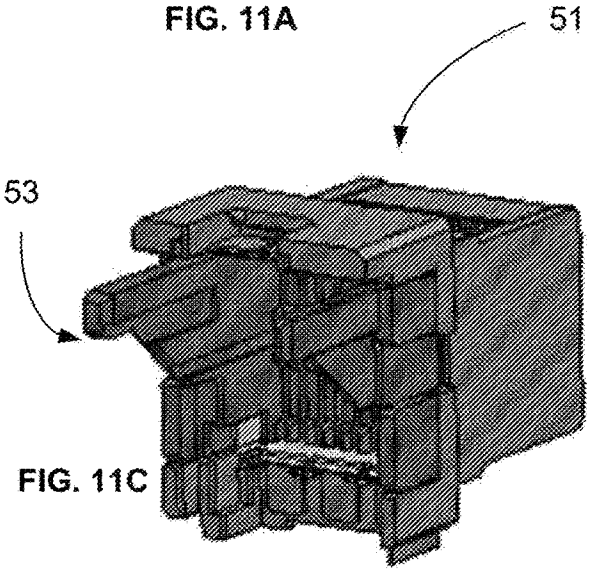

The inventors have further recognized and appreciated that complex molding operations may be required to position a ground shield between ports of a stacked connector, with receptacles such as 25*a* and 25*b*. Using conventional molding technology, a long, thin tool would be required in the molding operation to form a slot in a connector housing to receive a ground shield between receptacles 25*a* and 25*b*. However, in embodiments disclosed herein, front ground shield 50 may be readily positioned between receptacles 25*a* and 25*b* without a requirement to use a long thin tool during molding. A much shorter slot (visible in FIG. 9A and 9B)

may be formed through a forward surface of inner housing member 53. As shown, for example, in FIG. 8B, a relatively short portion of front ground shield 50 extends through the forward face of inner housing member 53. A correspondingly short slot may be formed in a rearward surface of front housing member 51 to receive that portion of front ground shield 50.

With such a manufacturing technique, front ground shield 50 may be readily incorporated in an interior portion of the connector housing. In conjunction with top ground shield 61 and bottom ground shield 63, shielding is provided above and below each receptacle. These shields are electrically tied together through grounds 41, or in any other suitable way.

In some embodiments, the cavity 100 may provide positioning and/or retention between the front housing member 51 and the top ground shield 61. For example, a top opening of the cavity 100 may be configured to receive one or more projections of the top ground shield 61 (e.g., the illustrative projection 65 shown in FIG. 6C) Likewise, the cavity 100 may provide positioning and/or retention between the front housing member 51 and the bottom ground shield 63. For example, a bottom opening of the cavity 100 may be configured to receive one or more projections of the bottom ground shield 63.

FIGS. 9A-D show perspective views of the inner housing member 53. As shown, the inner housing member 53 has channels 910 to receive the electrical contacts 24. However, the inner housing member 53 has a length in the lateral direction L that is sufficiently short that the electrical contacts 24 extend beyond a forward face of the inner housing member 53. In accordance with some embodiments, the electrical contacts 24 will extend into the front housing member 51.

FIGS. 10A-D show perspective views of the front housing member 51. As shown, the front housing member 51 has a face member 1020 with channels 1010 aligned with channels 910, such that the electrical contacts 24 may be positioned in the cavities formed between the front housing member 51 and the inner housing member 53.

The face member 1020 may be separated from a body portion 1030 of front housing member 53 by sidewalls 1040. The body portion 1030 may be shaped to receive the inner housing member 53. The sidewalls 1040 may have a length sufficient to position the face member 1020 forward of the forward face of inner housing member 53 when the inner housing member 53 is inserted in the body portion 1030. In this way, a separation between the forward surface of inner housing member 53 and the rearward surface of the face member 1020 may form the cavity 100.

FIGS. 11A-D show perspective views of the inner housing member 53 attached to the front housing member 51.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. As another example, while leadframe assemblies oriented in a lateral direction are illustrated, embodiments may be possible in which leadframe assemblies are orient perpendicular to the direction shown, such that each leadframe assembly forms an entire row of contacts. As yet a further example, it may be possible to insert leads into a housing without first forming a leadframe assembly.

Those skilled in the relevant art, having the benefit of the teachings of this specification, may effect numerous modifications to the invention as described herein, and changes may be made without departing from the spirit and scope of the invention, for instance as set forth by the appended claims.

The invention claimed is:

1. An electrical connector comprising:

an electrically insulative connector housing including i) a first housing member, ii) a second housing member separate from the first housing member, opposite the first housing member, and attached to the first housing member, and iii) an inner housing member between the first housing member and the second housing member, wherein the first housing member defines a receptacle configured to receive a paddle card;

a plurality of leadframe assemblies supported by, at least, the inner housing member of the connector housing, each of the leadframe assemblies including an electrically insulated leadframe housing and a plurality of electrical contacts supported by the leadframe housing, each of the electrical contacts defining a mating portion at the receptacle so as to be configured to contact the received paddle card, and a mounting portion opposite the mating portion; and a plurality of ground plates disposed between respective ones of the leadframe assemblies, the grounds each defining a ground mating portion at the receptacle so as to be configured to contact the received paddle card, and a ground mounting portion opposite the ground mating portion.

2. The electrical connector as recited in claim 1, wherein the leadframe assemblies include first and second pairs of electrical contacts, the first pair disposed at a first receptacle of the connector housing, and the second pair disposed at a second receptacle of the connector housing.

3. The electrical connector as recited in claim 1, further comprising a front ground shield, and the ground plates have respective openings that receives the front ground shield.

4. The electrical connector as recited in claim 3, wherein the front ground shield extends through the inner housing member into first housing member.

5. The electrical connector as recited in claim 1, wherein the connector housing comprises air pockets between the front housing member and the mating portions.

6. An electrical connector comprising:

an electrically insulative connector housing comprising a front housing member and an inner housing member that is separately manufactured from the front housing member, wherein the front housing member comprises at least one receptacle configured to receive an element of a mating connector; and a plurality of leadframe assemblies supported by the connector housing, each of the leadframe assemblies including an electrically insulated leadframe housing and a plurality of electrical contacts supported by the leadframe housing, each of the electrical contacts comprising a mating portion and a mounting portion opposite the mating portion, wherein:

the inner housing member comprises a plurality of slots;

the mating portions of the electrical contacts of the plurality of leadframe assemblies extend through respective ones of the plurality of slots of the inner housing;

the inner housing member is inserted at least partially into the front housing member; and at least some of the mating portions of the electrical contacts of the plurality of leadframe assemblies extend beyond a front face of the inner housing member, into the at least one receptacle of the first housing.

7. The electrical connector of claim 6, wherein:

each of the mating portions of the electrical contacts of the plurality of leadframe assemblies comprises an arced contact region adapting to make electrical connection with a corresponding contact pad;

for at least one leadframe assembly of the plurality of leadframe assemblies, the arced contact regions of the electrical contacts of the leadframe assembly are disposed in a cavity formed between the front face of the inner housing member and one or more inner surfaces of the front housing member.

8. The electrical connector of claim 6, further comprising:

a plurality of grounds, each ground comprising a ground plate, a ground mating portion extending from the ground plate, and a ground mounting portion extending from the ground plate, the ground mounting portion being opposite the ground mating portion.

9. The electrical connector of claim 8, wherein:

the plurality of leadframe assemblies are arranged in pairs;

at least one ground of the plurality of grounds is disposed between each adjacent pair of leadframe assemblies.

10. The electrical connector of claim 9, further comprising:

a top ground shield disposed between the first housing member and the inner housing member;

the plurality of grounds are electrically connected to each other via the top ground shield.

11. The electrical connector of claim 10, further comprising:

a bottom ground shield disposed between the first housing member and the inner housing member;

the plurality of grounds are electrically connected to each other via the bottom ground shield.

12. The electrical connector of claim 6, further comprising:

a rear housing member attached to the front housing member, wherein the inner housing member is captured between the rear housing member and the front housing member.

13. The electrical connector of claim 8, wherein:

the front housing member comprises an upper receptacle and a lower receptacle;

the upper receptacle and the lower receptacle are aligned in a transverse direction;

each of the upper receptacle and the lower receptacle is configured to receive a paddle card;

the electrical contacts of the plurality of leadframe assemblies comprise upper electrical contacts and lower electrical contacts;

the mating portions of the upper electrical contacts extend into the upper receptacle;

the mating portions of the lower electrical contacts extend into the lower receptacle; and the electrical connector further comprises a front ground shield disposed between the mating portions of the upper electrical contacts and the mating portions of the lower electrical contacts, the front ground shield extending through a first slot formed in the inner housing member and into a second slot formed in the front housing member.

14. The electrical connector of claim 12, wherein:

the plurality of grounds are electrically connected to each other via the front ground shield.

15. A method for assembling an electrical connector, the method comprising acts of:

arranging a plurality of leadframe assemblies in a lateral direction, wherein each of the leadframe assemblies includes an electrically insulated leadframe housing and a plurality of electrical contacts supported by the leadframe housing, each of the electrical contacts comprising a mating portion and a mounting portion opposite the mating portion;

assembling the plurality of leadframe assemblies into an inner housing member, wherein:

the inner housing member comprises a plurality of slots; and the mating portions of the electrical contacts of the plurality of leadframe assemblies extend through respective ones of the plurality of slots of the inner housing;

inserting the inner housing member, along with the plurality of leadframe assemblies, at least partially into a front housing member, wherein:

the front housing member is separately manufactured from the inner housing member;

the front housing member comprises at least one receptacle configured to receive a paddle card; and at least some of the mating portions of the electrical contacts of the plurality of leadframe assemblies extend beyond a front face of the inner housing member, into the at least one receptacle of the first housing.

16. The method of claim 15, wherein the act of arranging a plurality of leadframe assemblies comprises:

arranging the plurality of leadframe assemblies in pairs; and placing at least one ground of a plurality of grounds between each adjacent pair of leadframe assemblies, the at least one ground comprising a ground plate, a ground mating portion extending from the ground plate, and a ground mounting portion extending from the ground plate, the ground mounting portion being opposite the ground mating portion.

17. The method of claim 16, further comprising an act of:

prior to inserting the inner housing member into the front housing member, attaching a top ground shield to the plurality of leadframe assemblies, wherein:

the plurality of grounds are electrically connected to each other via the top ground shield; and the top ground shield is captured between the first housing member and the inner housing member once the inner housing member is inserted into the front housing member.

18. The method of claim 17, further comprising an act of:

prior to inserting the inner housing member into the front housing member, attaching a bottom ground shield to the plurality of leadframe assemblies, wherein:

the plurality of grounds are electrically connected to each other via the bottom ground shield; and the bottom ground shield is captured between the first housing member and the inner housing member once the inner housing member is inserted into the front housing member.

19. The method of claim 16, wherein:

the front housing comprises an upper receptacle and a lower receptacle;

the upper receptacle and the lower receptacle are aligned in a transverse direction;

each of the upper receptacle and the lower receptacle is configured to receive a paddle card;

the electrical contacts of the plurality of leadframe assemblies comprise upper electrical contacts and lower electrical contacts;

the mating portions of the upper electrical contacts extend into the upper receptacle; and the mating portions of the lower electrical contacts extend into the lower receptacle.

20. The method of claim 19, further comprising an act of:

prior to inserting the inner housing member into the front housing member, attaching a front ground shield to the plurality of leadframe assemblies, wherein:

the plurality of grounds are electrically connected to each other via the front ground shield;

the front ground shield is disposed between the mating portions of the upper electrical contacts and the mating portions of the lower electrical contacts; and the front ground shield extends through a first slot formed in the front housing member and a second slot formed in the inner housing member.

* * * * *